US008432340B2

(12) United States Patent
Okita et al.

(10) Patent No.: US 8,432,340 B2
(45) Date of Patent: Apr. 30, 2013

(54) LIQUID CRYSTAL DISPLAY DEVICE

(75) Inventors: Mitsutaka Okita, Hakusan (JP); Kazuhiro Nishiyama, Kanazawa (JP); Shigesumi Araki, Kanazawa (JP); Emi Kisara, Ishikawa-gun (JP)

(73) Assignee: Japan Display Central Inc., Fukaya-shi (JP)

( * ) Notice: Subject to any disclaimer, the term of this patent is extended or adjusted under 35 U.S.C. 154(b) by 1315 days.

(21) Appl. No.: 11/776,264

(22) Filed: Jul. 11, 2007

(65) Prior Publication Data

US 2008/0049005 A1 Feb. 28, 2008

(30) Foreign Application Priority Data

Jul. 12, 2006 (JP) ..... 2006-191902
Jul. 6, 2007 (JP) ..... 2007-178967

(51) Int. Cl.
*G09G 3/34* (2006.01)

(52) U.S. Cl.
USPC ..... 345/84; 345/694

(58) Field of Classification Search ..... 345/87–104, 345/694–696
See application file for complete search history.

(56) References Cited

U.S. PATENT DOCUMENTS

2003/0210221 A1* 11/2003 Aleksic ..... 345/102
2004/0104883 A1* 6/2004 Drader ..... 345/102
2006/0007194 A1* 1/2006 Verschueren et al. ..... 345/204
2006/0033749 A1* 2/2006 Yamada ..... 345/595
2006/0197735 A1* 9/2006 Vuong et al. ..... 345/102
2006/0256051 A1* 11/2006 Lee et al. ..... 345/87
2008/0055519 A1* 3/2008 Battersby et al. ..... 349/68

FOREIGN PATENT DOCUMENTS

JP 6-18880 1/1994
JP 10-282474 10/1998
JP 2000-193936 7/2000
WO WO 2006038192 A2 * 4/2006

OTHER PUBLICATIONS

U.S. Appl. No. 11/764,494, filed Jun. 18, 2007, Araki, et al.
U.S. Appl. No. 12/121,413, filed May 15, 2008, Higano, et al.
U.S. Appl. No. 13/282,651, filed Oct. 27, 2011, Kisara, et al.

* cited by examiner

*Primary Examiner* — Michael Pervan
(74) *Attorney, Agent, or Firm* — Oblon, Spivak, McClelland, Maier & Neustadt, L.L.P.

(57) ABSTRACT

A liquid crystal display device includes a reflective display part and a transmissive display part in each of a plurality of matrix-arrayed pixels. The liquid crystal display device includes a liquid crystal display panel which is configured such that a liquid crystal layer is held between a pair of substrates and gradation display is performed in accordance with a pixel voltage which is applied to the liquid crystal layer of each pixel, a backlight which illuminates the liquid crystal display panel, a sensor unit which detects brightness of ambient light, and a voltage setting unit which sets the pixel voltage relative to each of input gradation levels, on the basis of the brightness that is detected by the sensor unit.

7 Claims, 7 Drawing Sheets

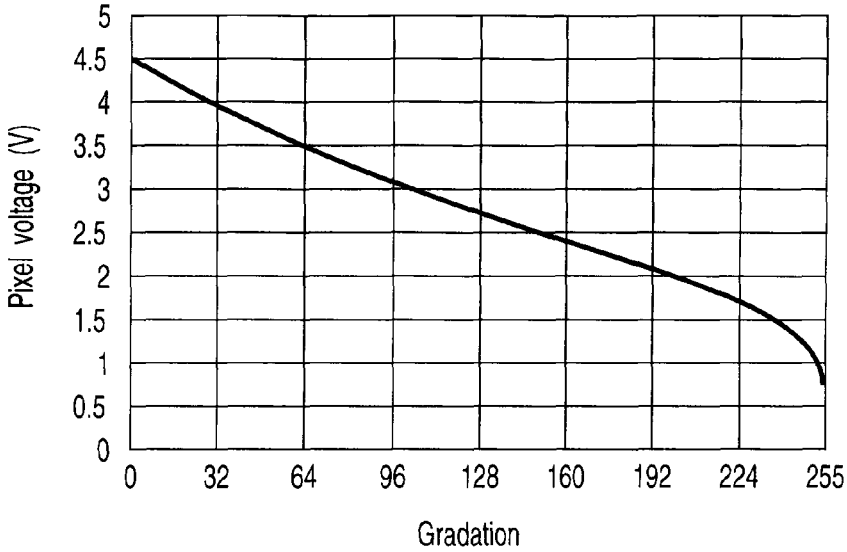
FIG. 3
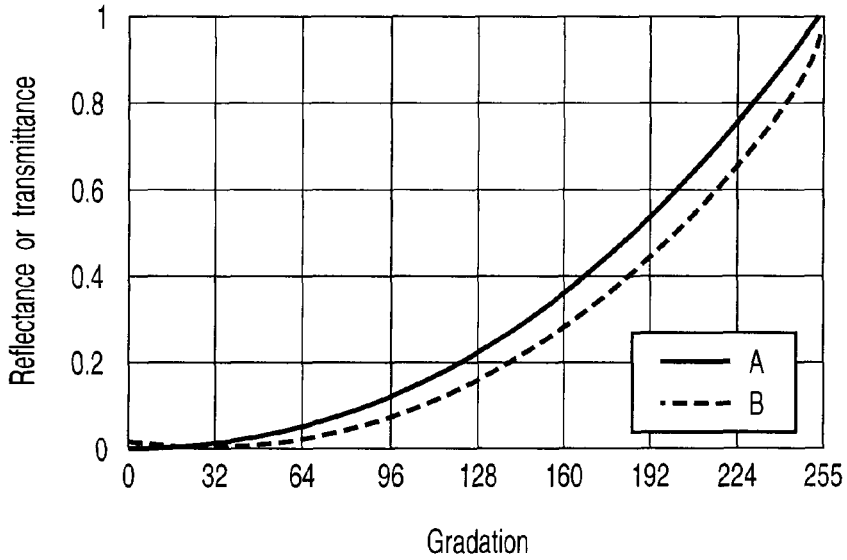
FIG. 4
| First example of structure | |
|---|---|
| Dark place | First mode |
| Light place | Second mode |
FIG. 5

| Second example of structure | |
|---|---|
| Dark place | First mode |
| | Third mode |
| Light place | Second mode |

| Third example of structure | |
|---|---|
| Dark place | First mode |
| Intermediate | Third mode |
| Light place | Second mode |

LIQUID CRYSTAL DISPLAY DEVICE

CROSS-REFERENCE TO RELATED APPLICATIONS

This application is based upon and claims the benefit of priority from prior Japanese Patent Applications No. 2006-191902, filed Jul. 12, 2006; and No. 2007-178967, filed Jul. 6, 2007, the entire contents of both of which are incorporated herein by reference.

BACKGROUND OF THE INVENTION

1. Field of the Invention

The present invention relates generally to a liquid crystal display device, and more particularly to a transflective liquid crystal display device having a reflective display mode in which ambient light is selectively reflected and a transmissive display mode in which backlight is selectively transmitted.

2. Description of the Related Art

Liquid crystal display devices have widely been applied to various technical fields by virtue of their features such as light weight, small thickness and low power consumption.

The liquid crystal display device has been required to eliminate a difference in appearance of the display screen due to the environment of use, in particular, ambient brightness. For example, in order to optimize the brightness of transmissive display in a dark place, a technique has been disclosed to provide a device which measures the amount of ambient light, adjusts the luminance of an illumination light source in accordance with the measured result, and effects easy-to-view display with a proper luminance and a less amount of electric current consumed (see, e.g. Jpn. Pat. Appln. KOKAI Publication No. 6-18880). In addition, in order to improve degradation in gradation of reflective display in a light place, a technique has been proposed to partially thin out video signal bits in accordance with the intensity of ambient light, and to reduce the number of signal bits that are used, thereby limiting the number of gradation levels of display and increasing a difference in luminance between gradation levels (see, e.g. Jpn. Pat. Appln. KOKAI Publication No. 10-282474).

In recent years, attention has been paid to a liquid crystal display device which uses an optically compensated bend (OCB) alignment technique, as a liquid crystal display device which can realize an increase in viewing angle and response speed. The OCB mode liquid crystal display device is configured such that a liquid crystal layer including liquid crystal molecules, which are bend-aligned, is held between a pair of substrates in a state in which a predetermined voltage is applied. Compared to a twisted nematic (TN) mode, the OCB mode is advantageous in that the response speed can be increased and the viewing angle can be increased since the effect of birefringence of light, which passes through the liquid crystal layer, can be self-compensated by the alignment state of liquid crystal molecules.

In addition, there has been proposed a transflective OCB liquid crystal display in which each of pixels includes a reflective display part and a transmissive display part.

In the transflective liquid crystal display device, a good display image can be obtained, regardless of the environment of use, by mainly executing, in a light place, display in the reflective display mode by the reflective display part, and by mainly executing, in a dark place, display in the transmissive display mode by the transmissive display part.

However, it is not possible to make the voltage-transmittance characteristics in the transmissive display part agree completely with the voltage-reflectance characteristics in the reflective display part.

In the above-described transflective liquid crystal display device, in general, a pixel electrode which constitutes the reflective display part is electrically connected to a pixel electrode which constitutes the transmissive display part. Thus, in the case where a voltage relative to an input gradation level is common between the transmissive display part and reflective display part, the transmittance characteristics (transmissive gamma) relative to the input gradation level in the transmissive display part do not agree with the reflectance characteristics (reflective gamma) relative to the input gradation level in the reflective display part.

Consequently, a difference occurs in appearance of the display screen due to the environment of use, in particular, due to ambient brightness. Specifically, in the case where the gamma characteristics are different between the reflective display part and transmissive display part, there arises a problem that the image quality of the display screen differs between a light place where the reflective display mode is a main mode and a dark place where the transmissive display mode is a main mode.

BRIEF SUMMARY OF THE INVENTION

The present invention has been made in consideration of the above-described problems, and the object of the invention is to provide a transflective liquid crystal display device which can obtain a display screen with a predetermined image quality, regardless of the environment of use.

According to an aspect of the present invention, there is provided a liquid crystal display device including a reflective display part and a transmissive display part in each of a plurality of matrix-arrayed pixels, comprising: a liquid crystal display panel which is configured such that a liquid crystal layer is held between a pair of substrates and gradation display is performed in accordance with a pixel voltage which is applied to the liquid crystal layer of each pixel; a backlight which illuminates the liquid crystal display panel; a sensor unit which detects brightness of ambient light; and a voltage setting unit which sets the pixel voltage relative to each of input gradation levels, on the basis of the brightness that is detected by the sensor unit.

The present invention can provide a transflective liquid crystal display device which can obtain a display screen with a predetermined image quality, regardless of the environment of use.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 3 shows an example of setting of a pixel voltage relative to an input gradation, which is applicable to the liquid crystal display device shown in FIG. 1;

FIG. 4 shows gamma characteristics of transmittance and gamma characteristics of reflectance, relative to the input gradation in the example of setting in FIG. 3;

FIG. 5 is a view for explaining a first example of structure;

DETAILED DESCRIPTION OF THE INVENTION

A liquid crystal display device according to an embodiment of the invention will now be described with reference to the accompanying drawings. A description is given of, as an example of the liquid crystal display device, a transflective liquid crystal display device which includes, in each of pixels, a reflective display part that displays an image by selectively reflecting ambient light and a transmissive display part that displays an image by selectively transmitting backlight.

Figure 1:
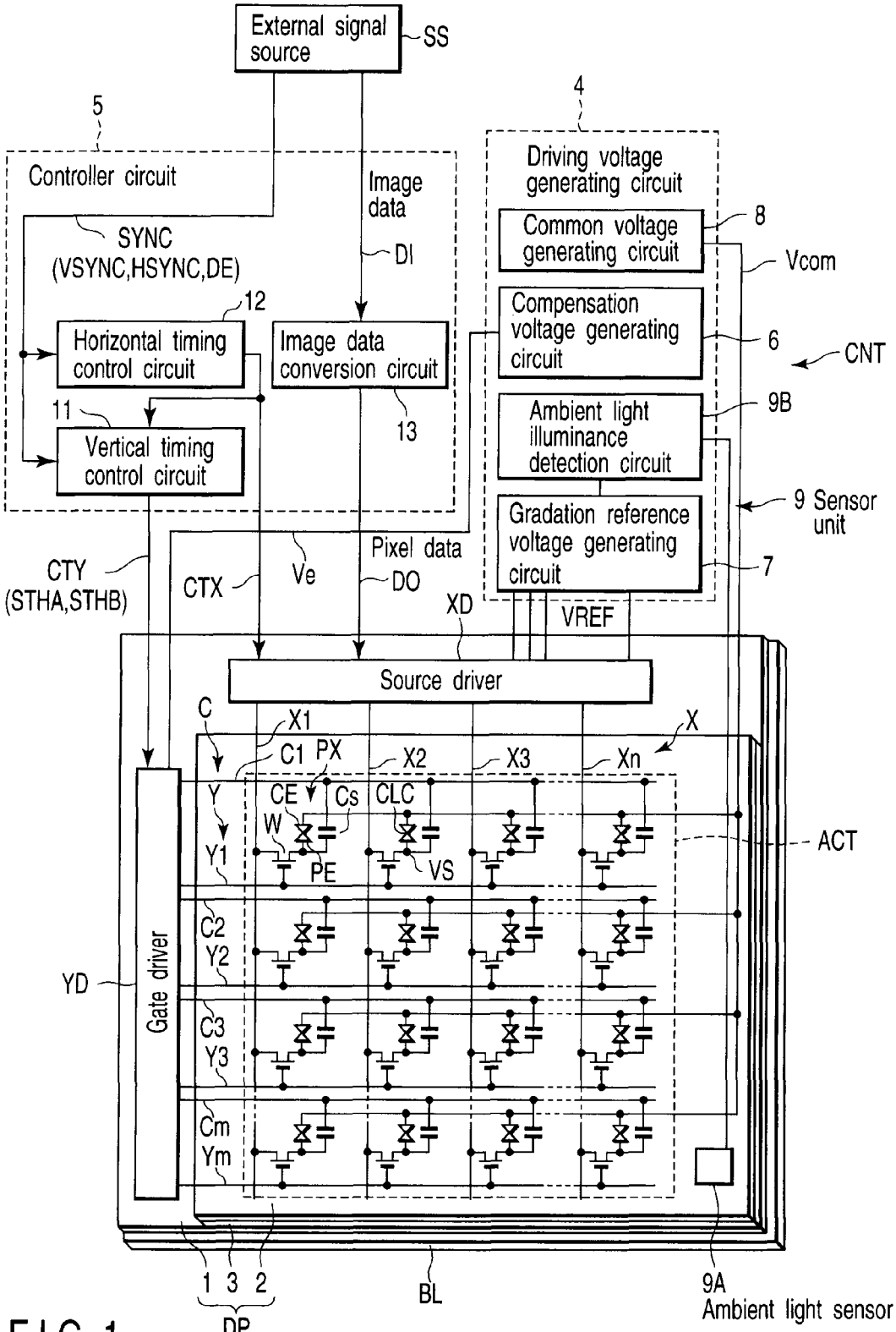
FIG. 1 schematically shows the circuit structure of a liquid crystal display device according to an embodiment of the present invention.
Figure 2A:
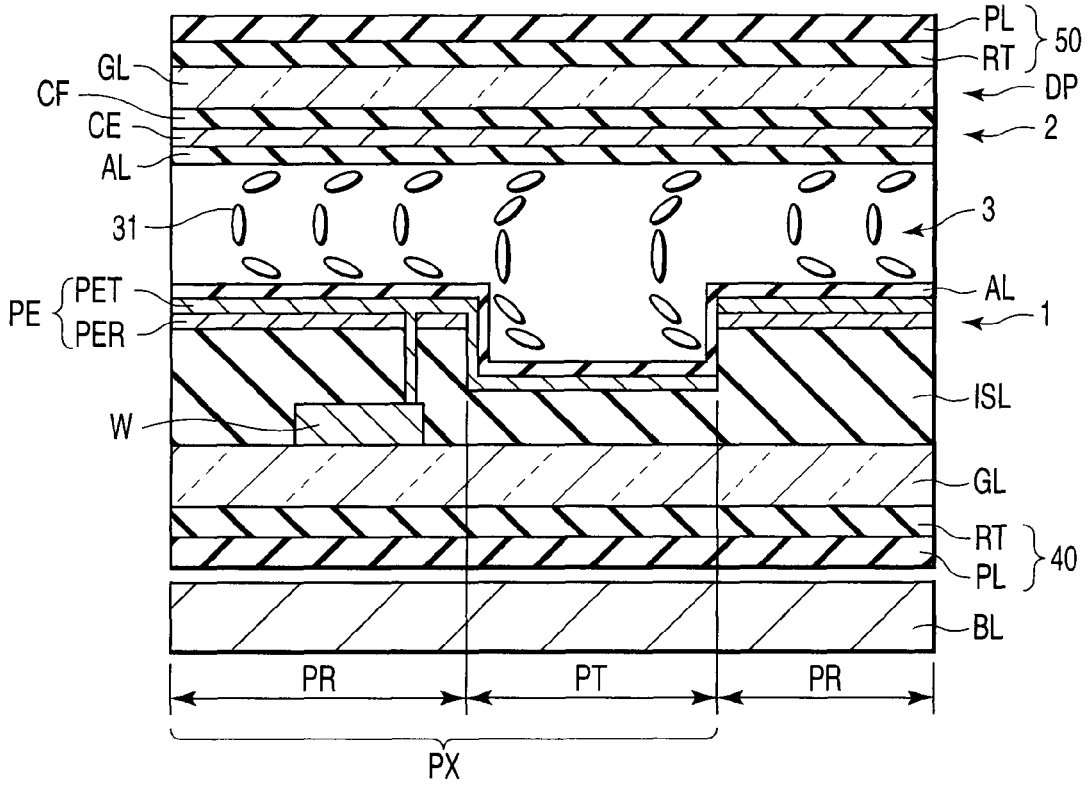
FIG. 2A schematically shows a cross-sectional structure of a liquid crystal display panel which is applicable to the liquid crystal display device shown in FIG. 1.

As shown in FIG. 1, the liquid crystal display device is configured to include a liquid crystal display panel DP, a backlight BL that illuminates the liquid crystal display panel DP, and a display control circuit CNT that controls the liquid crystal display panel DP and the backlight BL. The liquid crystal display panel DP is configured such that a liquid crystal layer 3 is held between a pair of substrates, i.e. an array substrate 1 and a counter-substrate 2, and the liquid crystal display panel DP includes an active area ACT that displays an image. The active area ACT is composed of a plurality of matrix-arrayed pixels PX. As shown in FIG. 2A, each of the pixels PX includes a reflective display part PR that displays an image by selectively reflecting ambient light in a reflective display mode, and a transmissive display part PT that displays an image by selectively transmitting light from a backlight BL in a transmissive display mode.

The array substrate 1 includes a light-transmissive insulating substrate GL such as a glass plate; a plurality of pixel electrodes PE which are arrayed in a matrix on the insulating substrate GL; an insulating layer ISL for providing a gap difference in the liquid crystal layer 3, thereby to impart a difference in retardation between the reflective display part PR and the transmissive display part PT; and an alignment film AL which is formed on the pixel electrodes PE.

In the array substrate 1, a plurality of gate lines Y (Y1 to Ym) are disposed along rows of the pixel electrodes PE, and a plurality of source lines X (X1 to Xn) are disposed along columns of the pixel electrodes PE. Switching elements W are disposed near intersections between the gate lines Y and source lines X. Each of the switching elements W is composed of, e.g. a thin-film transistor. The gate of the switching element W is connected to the associated gate line Y. The source and drain of the switching element W are connected to the associated source line X and pixel electrode PE, respectively. When the switching element W is driven via the associated gate line Y, the switching element W is rendered conductive between the associated source line X and associated pixel electrode PE.

Each of the pixel electrodes PE includes a reflective electrode PER which is provided in association with the reflective display part PR, and a transmissive electrode PET which is provided in association with the transmissive display part PT. The electrodes PER and PET are electrically connected and are controlled by a single switching element W. The reflective electrode PER is formed of a light-reflective electrically conductive material such as aluminum (Al). The transmissive electrode PET is formed of a light-transmissive electrically conductive material such as indium tin oxide (ITO). The reflective electrode PER and transmissive electrode PET are electrically connected to the switching element W. The pixel electrodes PE with this structure are covered with the alignment film AL.

The counter-substrate 2 includes a light-transmissive insulating substrate GL such as a glass plate, a color filter layer CF that is formed on the insulating substrate GL, a common electrode CE that is formed on the color filter layer CF, and an alignment film AL that is formed on the common electrode CE.

The color filter layer CF includes a red colored layer for a red pixel, a green colored layer for a green pixel, a blue colored layer for a blue pixel, and a black colored layer which functions as a black matrix between pixels and as a peripheral light-blocking layer. The common electrode CE is disposed commonly for the plural pixels PX, and is formed of a light-transmissive electrically conductive material such as ITO. The common electrode CE with this structure is covered with the alignment film AL.

The array substrate 1 and counter-substrate 2 having the above-described structures are disposed with a predetermined gap therebetween via a spacer (not shown), and are attached to each other by a sealing material. The liquid crystal layer 3 is sealed in the gap between the array substrate 1 and counter-substrate 2. In this embodiment, the liquid crystal display panel DP is configured to have an OCB (Optically Compensated Bend) mode. The liquid crystal layer 3 is formed of a material including liquid crystal molecules 31 which have positive dielectric constant anisotropy and optically positive uniaxiality. For example, in order to execute a normally-white display operation, the liquid crystal molecules 31 are transitioned in advance from splay alignment to bend alignment at a time of the display operation, and reverse transition from the bend alignment to the splay alignment is prevented by applying a high voltage, for example, a black voltage that is periodically applied to effect black display. In the example shown in FIG. 2A, in the transmissive display part PT and reflective display part PR, the liquid crystal molecules 31 are bend-aligned between the array substrate 1 and counter-substrate 2 in a predetermined display state in which a voltage is applied to the liquid crystal layer 3.

As shown in FIG. 1, each of the pixels PX has a liquid crystal capacitance CLC between the pixel electrode PE and the common electrode CE. Each of a plurality of storage capacitor lines C1 to Cm is capacitive-coupled to the pixel electrodes PE of the pixels PX of the associated row, and constitutes storage capacitors Cs. The storage capacitor Cs has a sufficiently high capacitance value, relative to a parasitic capacitance of the switching element W.

The display control circuit CNT controls the transmittance and reflectance of the liquid crystal display panel DP by a liquid crystal driving voltage that is applied to the liquid crystal layer 3 from the array substrate 1 and counter-substrate 2. The transition from the splay alignment to the bend alignment is carried out by applying a relatively high electric field to the liquid crystal in a predetermined initializing process which is performed by the display control circuit CNT at the time of power-on.

The display control circuit CNT includes a gate driver YD which sequentially drives the gate lines Y1 to Ym so as to turn on the switching elements W on a row-by-row basis; a source driver XD which outputs pixel voltages Vs to the source lines X1 to Xn during the period in which the switching elements W of each row are turned on by the driving of the associated gate line Y; a driving voltage generating circuit 4 which generates driving voltages for the liquid crystal display panel DP; and a controller circuit 5 which controls the gate driver YD and source driver XD.

The driving voltage generating circuit 4 includes a compensation voltage generating circuit 6 which generates a compensation voltage Ve that is applied to the storage capacitor line C via the gate driver YD; a gradation reference voltage generating circuit 7 which generates a predetermined number of gradation reference voltages VREF that are used by the source driver XD; and a common voltage generating circuit 8 which generates a common voltage Vcom that is applied to the common electrode CE.

The controller circuit 5 includes a vertical timing control circuit 11 which generates a control signal CTY for the gate driver YD on the basis of sync signals SYNC (VSYNC, DE) that are input from an external signal source SS; a horizontal timing control circuit 12 which generates a control signal CTX for the source driver XD on the basis of sync signals SYNC (HSYNC, DE) that are input from the external signal source SS; and an image data conversion circuit 13 which executes desired conversion on the basis of, e.g. the number of pixels or a black insertion ratio, with respect to image data D1 that are input from the external signal source SS in association with the respective pixels PX.

As is shown in FIG. 2A, the liquid crystal display device further includes a first optical compensation element 40 that is disposed between the liquid crystal display panel DP and the backlight BL (i.e. on an outside surface of the array substrate 1), and a second optical compensation element 50 that is disposed on an observation surface side of the liquid crystal display panel DP (i.e. on an outside surface of the counter-substrate 2). Each of the first optical compensation element 40 and second optical compensation element 50 includes at least one retardation plate RT and at least one polarizer plate PL, and has a function of optically compensating the retardation of the liquid crystal layer 3 in a predetermined display state in which a voltage is applied to the liquid crystal layer 3 in the above-described liquid crystal display panel DP.

In the meantime, in the above-described transflective liquid crystal display device, the reflective display mode by the reflective display part PR is dominant in a light place, and the brightness of the display screen depends mainly on the brightness of ambient light that is incident on the liquid crystal display panel DP. On the other hand, the transmissive display mode by the transmissive display part PT is dominant in a dark place, and the brightness of the display screen depends mainly on the brightness of the backlight BL.

In the case where the display device is driven by fixing each pixel voltage Vs relative to each input gradation level, regardless of the environment of use, in particular, the brightness of the ambience, the reflectance characteristics (reflective gamma) relative to the input gradation level in the reflective display part PR do not always agree with the transmittance characteristics (transmissive gamma) relative to the input gradation level in the transmissive display part PT. FIG. 3 shows an example of setting of a pixel voltage relative to an input gradation (gradation levels). In FIG. 3, the number of gradation levels is 256, and a gradation level "0" corresponds to black display and a gradation level "255" corresponds to white display.

A curve A in FIG. 4 indicates an example of the relationship (transmittance gamma) between the input gradation and transmittance in the transmissive display part PT, and a curve B in FIG. 4 indicates an example of the relationship (reflectance gamma) between the input gradation and reflectance in the reflective display part PR. In these examples, a reflectance at a maximum gradation level is set at 1, and a transmittance at a maximum gradation level is set at 1.

According to the characteristics shown in FIG. 4, the reflectance (reflectance gamma) and the transmittance (transmittance gamma) relative to the input gradation are different between the light place where the influence of the characteristics of the reflective display part PR is strong and the dark place where the influence of the characteristics of the transmissive display part PT is strong. Thus, the image quality of the display screen relative to the same input gradation is different. In short, the appearance of the display screen is different between the light place and the dark place.

To cope with this, in the present embodiment, the set value of the pixel voltage Vs, relative to the gradation of the input to the liquid crystal display panel DP, is varied (optimized) in accordance with the brightness of ambient light that is incident on the liquid crystal display panel DP. Thereby, a difference is decreased between the reflectance (reflectance gamma) relative to the input gradation in the light place where the reflective display mode is dominant and the transmittance (transmittance gamma) relative to the input gradation in the dark place where the transmissive display mode is dominant. Hence, a difference in image quality of the display screen can be reduced and a predetermined image quality can be obtained regardless of the ambient brightness.

To be more specific, as shown in FIG. 1, the liquid crystal display device includes a sensor unit 9 which detects the brightness of ambient light that is incident on the liquid crystal display panel DP. The sensor unit 9 outputs a detection signal corresponding to, e.g. illuminance (lux), as the brightness of ambient light. Specifically, the sensor unit 9 comprises an ambient light sensor 9A and an ambient light illuminance detection circuit 9B.

Figure 2B:
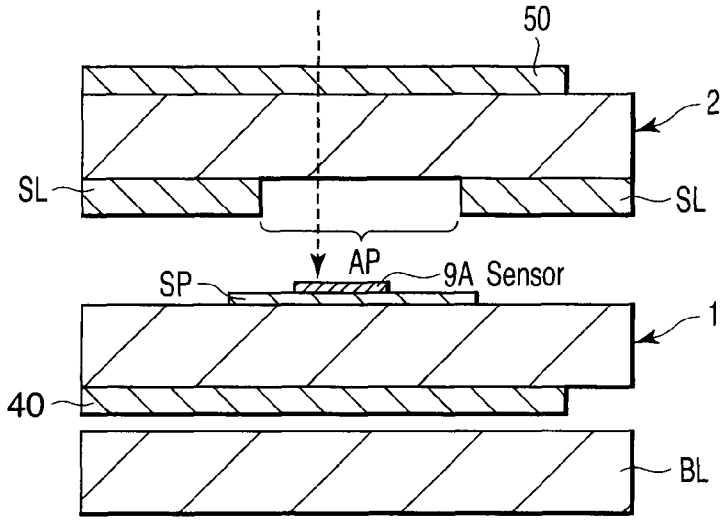
FIG. 2B schematically shows a cross-sectional structure of a peripheral part of the liquid crystal display panel which is applicable to the liquid crystal display device shown in FIG. 1.

The ambient light sensor 9A is disposed, for example, outside the active area ACT. As shown in FIG. 2B, the counter-substrate 2 includes a peripheral light-blocking layer SL, which is disposed in a frame shape, on the outside of the active area ACT of the liquid crystal display panel DP. Thereby, leak of light from the backlight BL is prevented. The ambient light sensor 9A is disposed on the array substrate 1. An opening AP is provided in the peripheral light-blocking layer SL, and the ambient light sensor 9A is disposed to be opposed to the opening AP. A light-blocking pattern SP is provided under the ambient light sensor 9A so that the light from the backlight BL may not directly be incident on the ambient light sensor 9A and that only ambient light may exactly be detected.

The ambient light sensor 9A is composed of, e.g. a PIN diode, and may be formed integral with the array substrate 1. In this case, the ambient light sensor 9A may be formed by using, for example, low-temperature polysilicon technology, like the thin-film transistors that constitute the switching elements W on the array substrate 1, and may be formed at the same time as these thin-film transistors.

Figure 2C:
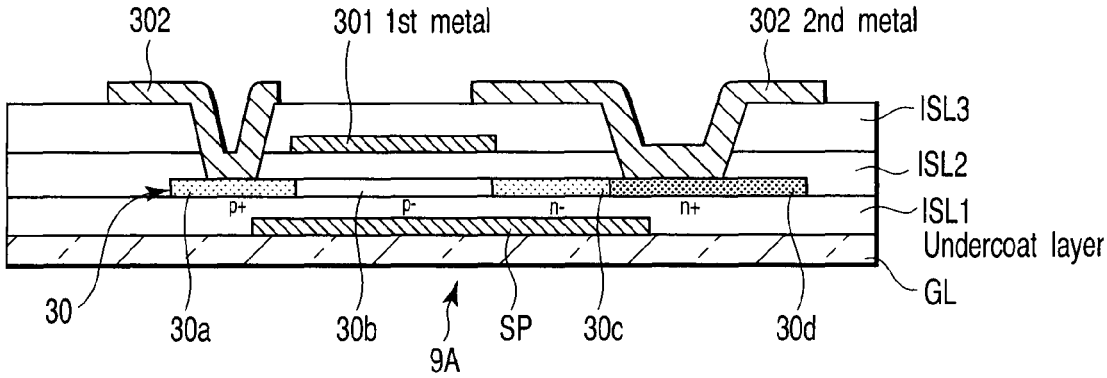
FIG. 2C schematically shows an example of a cross-sectional structure of an ambient light sensor shown in FIG. 2B.

As shown in FIG. 2C, the PIN diode that constitutes the ambient light sensor 9A is disposed on the light-blocking pattern SP on the insulating substrate GL. The light-blocking pattern SP is formed of a metallic material (e.g. Mo—W alloy). The light-blocking pattern SP is connected to a power supply line (not shown) via a through-hole (not shown), and is set at a specified potential (e.g. GND level) at least in the sensor part.

The PIN diode includes a polycrystalline semiconductor layer (polysilicon layer) 30 which is disposed on the insulating substrate GL via an undercoat layer ISL1. The polycrystalline semiconductor layer 30 is used as a channel layer. The undercoat layer ISL1 may be dispensed with.

The polycrystalline semiconductor layer 30 includes a $p^+$ region 30*a*, $p^-$ region 30*b*, $n^-$ region 30*c* and $n^+$ region 30*d*. A diode is constituted by the horizontal formation of the $p^+/p^-/n^-/n^+$ regions. When the $p^+$ side is set at GND (0V) and the $n^+$ side is set at 5V, a photoelectric current corresponding to the illumination light intensity flows between both ends of the diode.

The PIN diode may be formed without the $n^-$ region 30*c*. In FIG. 2C, the respective regions are formed in the horizontal direction (i.e. an in-plane direction of the substrate) and thus the PIN diode is formed. Alternatively, these regions may be stacked in the vertical direction (i.e. a thickness direction of the substrate) and thus the PIN diode may be formed.

Insulation layers ISL2 and ISL3 are disposed on the polycrystalline semiconductor layer 30. A first metal 301 is disposed on the polycrystalline semiconductor layer 30 via the insulation layer ISL2. In addition, second metals 302 are connected to the $p^+$ region 30*a* and $n^+$ region 30*d* of the polycrystalline semiconductor layer 30 via contact holes that penetrate the insulation layers ISL2 and ISL3.

The ambient light sensor 9A with this structure outputs a photoelectric current, which corresponds to the illumination intensity of ambient light that is incident from the counter-substrate 2 side, to the ambient light illuminance detection circuit 9B. The ambient light illuminance detection circuit 9B outputs an output signal (i.e. a detection signal), which corresponds to the output from the ambient light sensor 9A, to the gradation reference voltage generating circuit 7.

The gradation reference voltage generating circuit 7 and the source driver XD function as a voltage setting unit which sets pixel voltages Vs corresponding to respective input gradation levels on the basis of the brightness of the ambient light detected by the sensor unit 9. To be more specific, the voltage setting unit sets the pixel voltages Vs so as to compensate a difference between the reflectance (reflectance gamma) relative to the input gradation in the reflective display mode which is dominant in the light place and the transmittance (transmittance gamma) relative to the input gradation in the transmissive display mode which is dominant in the dark place.

Specifically, image data D1, which is input from the external signal source SS, is composed of a plurality of pixel data corresponding to a plurality of pixels PX. The image data D1 is converted to pixel data DO by the image data conversion circuit 13. The converted pixel data DO is delivered to the source driver XD. On the other hand, the gradation reference voltage generating circuit 7 has a function of shifting a power supply voltage, which is a reference voltage, in accordance with the brightness of ambient light detected by the sensor unit 9. In other words, the shift amount of the power supply voltage is determined, depending on the brightness of ambient light. Making use of this function, the gradation reference voltage generating circuit 7 generates a predetermined number of gradation reference voltages VREF. The source driver XD is configured to set the pixel voltages Vs relative to the input gradation levels, with reference to the predetermined number of gradation reference voltages VREF which are supplied from the gradation reference voltage generating circuit 7. The source driver XD converts the pixel data DO, which are delivered from the image data conversion circuit 13, to the pixel voltages Vs and outputs the pixel voltages Vs to the source lines X1 to Xn in a parallel fashion.

By the above-described structure, it is possible to make the reflectance (reflectance gamma) relative to the input gradation in the reflective display mode, which is dominant in the light place, substantially agree with the transmittance (transmittance gamma) relative to the input gradation in the transmissive display mode which is dominant in the dark place. Therefore, regardless of the brightness of ambient light, a display screen with a predetermined image quality can be displayed on the liquid crystal display panel DP.

Next, a description is given of a first example of structure in a case where a first mode and a second mode are switched, as shown in FIG. 5, when the brightness of the ambience is higher than a predetermined threshold. In the first example of structure, the threshold of illuminance for switching the first mode and second mode is set at, e.g. 1000 lx.

Figure 6:
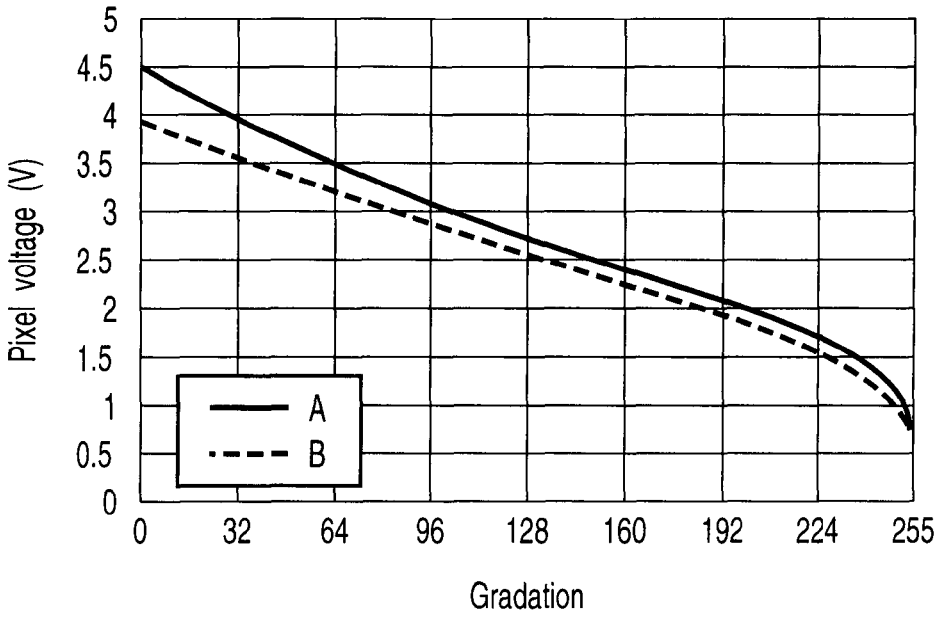
FIG. 6 shows an example of setting of a pixel voltage relative to an input gradation in the first example of structure, which is applicable to the liquid crystal display device shown in FIG. 1.

In the case where the sensor unit 9 detects that the brightness of ambient light is the threshold value or less, for example, in the case where the sensor unit 9 detects that the illuminance is 450 lx (dark place), the voltage setting unit selects the first mode and sets the pixel voltages Vs relative to the input gradation, for example, as indicated by a curve A in FIG. 6. In the dark place, the transmissive display mode by the transmissive display unit PT is dominant (i.e. the contribution to the display by the reflective display mode is low). Thus, the pixel voltages Vs relative to the input gradation are optimized so as to obtain a predetermined image quality in the transmissive display mode. In other words, in this case, an image is displayed mainly by selective transmission of backlight by the operation of the transmissive display part PT of each pixel PX (Main; transmissive display mode). On the other hand, ambient light supplementarily contributes to the image display by the operation of the reflective display part PR of each pixel PX (Sub; reflective display mode).

On the other hand, in the case where the sensor unit 9 detects that the brightness of ambient light is higher than the threshold value, for example, in the case where the sensor unit 9 detects that the illuminance is 1600 lx (light place), the voltage setting unit selects the second mode and sets the pixel voltages Vs relative to the input gradation, for example, as indicated by a curve B in FIG. 6. In this example, the pixel voltages Vs relative to the input gradation in the second mode are lower than in the first mode. In the light place where the brightness of ambient light is sufficiently high, the reflective display mode by the reflective display unit PR is dominant (i.e. the contribution to the display by the transmissive display mode is low). Thus, the pixel voltages Vs relative to the input gradation are optimized so as to obtain a predetermined image quality in the reflective display mode. In other words, in this case, an image is displayed mainly by selective reflection of ambient light by the operation of the reflective display part PR of each pixel PX (Main; reflective display mode). On the other hand, backlight supplementarily contributes to the image display by the operation of the transmissive display part PT of each pixel PX (Sub; transmissive display mode).

As shown in FIG. 6, a difference occurs in pixel voltages Vs relative to the input gradation between the case in which the pixel voltages Vs are optimized by paying attention to only the characteristics of the transmissive display mode and the case in which the pixel voltages Vs are optimized by paying attention to only the characteristics of the reflective display mode.

Figure 7:
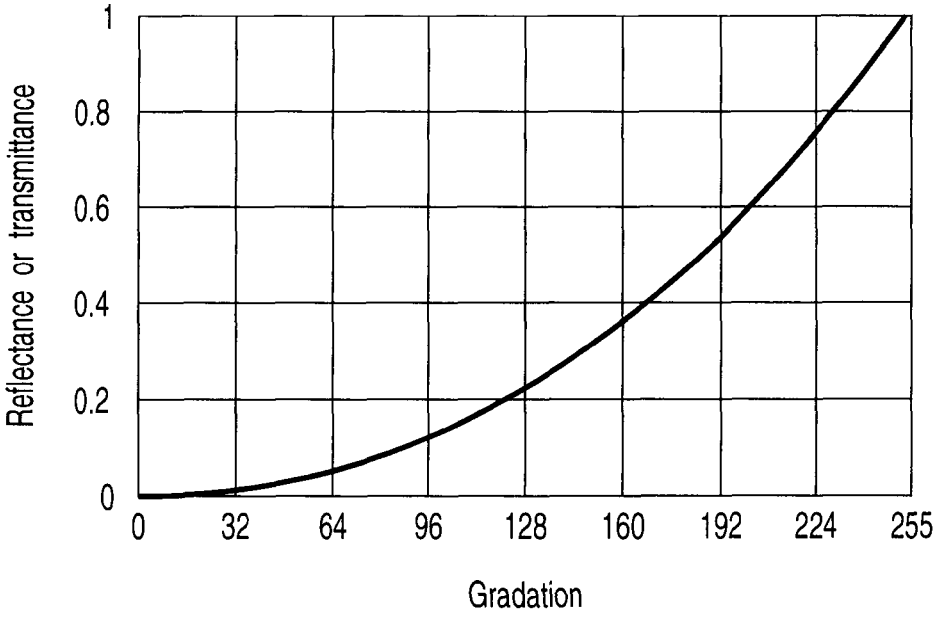
FIG. 7 shows gamma characteristics of transmittance and gamma characteristics of reflectance, relative to the input gradation in the example of setting in FIG. 6.

If the liquid crystal display device with the above setting is driven, a relationship shown in FIG. 7 is obtained between the reflectance (reflectance gamma) relative to the input gradation of the liquid crystal display panel DP in a light place where the brightness of ambient light is sufficiently high, and the transmittance (transmittance gamma) relative to the input gradation of the liquid crystal display panel DP in a dark place where the brightness of ambient light is sufficiently low. Thus, the transmittance characteristics relative to the input gradation are substantially equal to the reflectance characteristics relative to the input gradation. In short, a display screen with a predetermined image quality can be obtained in the light place and dark place, and a difference in appearance of the display screen can be decreased.

In the above-described first example of structure, when the ambient brightness exceeds the threshold, the first mode and second mode are switched. The invention is not limited to this example. For example, it is possible to add a third mode in which pixel voltages relative to the input gradation are set between the pixel voltages in the first mode and the pixel voltages in the second mode.

Figures 8, 9:
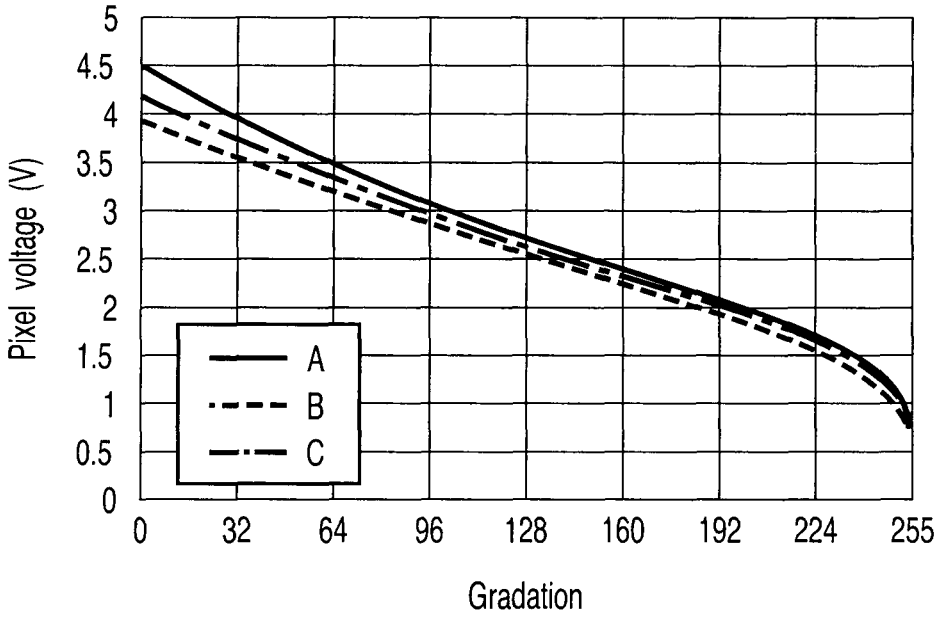
FIG. 8 is a view for explaining a second example of structure.
FIG. 9 shows an example of setting of a pixel voltage relative to an input gradation in the second example of structure, which is applicable to the liquid crystal display device shown in FIG. 1.

A description is given of a second example of structure in a case where the first mode and the second mode are switched with a transition via a third mode, as shown in FIG. 8, when the brightness of the ambience becomes higher than a predetermined threshold. In the second example of structure, like the first example of structure, the threshold of illuminance for switching the first mode and second mode is set at, e.g. 1000 lx.

In the first mode that is selected in the dark place, the pixel voltages Vs relative to the input gradation are set, for example, as indicated by a curve A in FIG. 9. In the second mode that is selected in the light place, the pixel voltages Vs relative to the input gradation are set, for example, as indicated by a curve B in FIG. 9. In this example, in particular, the pixel voltages Vs relative to the input gradation in the second mode are lower than in the first mode.

In the third mode, the pixel voltages Vs relative to the input gradation are set, for example, as indicated by a curve C in FIG. 9. In this example, the pixel voltages Vs relative to the input gradation in the third mode are set at a substantially intermediate level between the first mode and the second mode.

In this structure, when the ambient brightness has exceeded the threshold value, direct switching is not executed from the first mode to the second mode, or from the second mode to the first mode. Instead, the third mode is selected only within a period of several frames (e.g. less than 10 frames). Specifically, switching is executed in the order of "first mode ⇒ third mode ⇒ second mode", or "second mode ⇒ third mode ⇒ first mode". With this structure, even in the case where the ambient brightness sharply changes, the unnatural sensation relating to the display quality due to the mode switching can be relaxed by the provision of the third mode between the first mode and the second mode.

It is not always necessary that the mode switching is executed with a transition via the third mode both in the case of a sharp change of ambient brightness from "light" to "dark" ("light ⇒ dark") and in the case of a sharp change of ambient brightness from "dark" to "light" ("dark ⇒ light"). For example, in the case of the sharp change of ambient brightness from "light" to "dark", the mode switching may be executed in the order of "second mode ⇒ third mode ⇒ first mode". In the case of the sharp change of ambient brightness from "dark" to "light", the mode may directly be switched from the first mode to the second mode ("first mode ⇒ second mode") without a transition via the third mode.

Figures 10, 11:
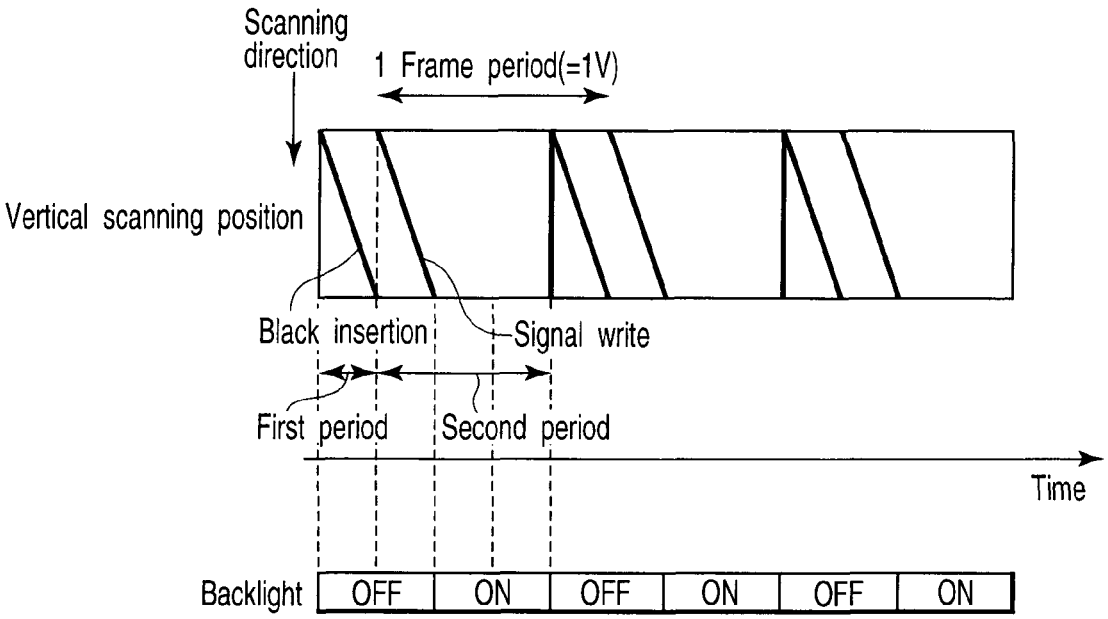
FIG. 10 is a view for explaining a third example of structure.
FIG. 11 is a view for explaining a black insertion driving scheme, which is applicable to the liquid crystal display device shown in FIG. 1.

Next, a description is given of a third example of structure in a case where the mode switching to a third mode is executed when the ambient brightness is an intermediate level between the ambient brightness in the dark place and the ambient brightness in the light place, as shown in FIG. 10. In the third example of structure, a first threshold of illuminance for switching the first mode and third mode is set at, e.g. 800 lx, and a second threshold of illuminance for switching the second mode and third mode is set at, e.g. 1200 lx.

In the case where the sensor unit 9 detects that the brightness of ambient light is the first threshold value or less, for example, in the case where the sensor unit 9 detects that the illuminance is 450 lx (dark place), the voltage setting unit selects the first mode and sets the pixel voltages Vs relative to the input gradation, for example, as indicated by a curve A in FIG. 9.

In the case where the sensor unit 9 detects that the brightness of ambient light is higher than the first threshold value and is not higher than the second threshold, for example, in the case where the sensor unit 9 detects that the illuminance is 1000 lx (intermediate), the voltage setting unit selects the third mode and sets the pixel voltages Vs relative to the input gradation, for example, as indicated by a curve C in FIG. 9.

In the case where the sensor unit 9 detects that the brightness of ambient light is higher than the second threshold, for example, in the case where the sensor unit 9 detects that the illuminance is 1600 lx (light place), the voltage setting unit selects the second mode and sets the pixel voltages Vs relative to the input gradation, for example, as indicated by a curve B in FIG. 9.

The first mode, second mode and third mode in this case are the same as those in the second example of structure, so a detailed description thereof is omitted.

With the above-described structure, too, the same advantageous effects as in the first example of structure and second example of structure can be obtained.

In the meantime, as regards the OCB mode liquid crystal display panel DP, there has been proposed a driving scheme in which a relatively high voltage is periodically applied to the liquid crystal layer with respect to all the pixels, thereby to prevent reverse transition of liquid crystal molecules and to improve the visibility of a moving image. In the case of the normally-white liquid crystal display panel DP, this driving scheme is called "black-insertion driving scheme" since the voltage to be applied corresponds to a pixel voltage that effects black display.

In a black-insertion driving scheme shown in FIG. 11, to begin with, using a first period, the gate driver YD and source driver XD execute black-insertion write (i.e. application of a pixel voltage for black display) successively in all pixels PX. Then, using a second period that follows the first period, the gate driver YD and source driver XD execute video signal write (i.e. application of a pixel voltage for gradation display) successively in all pixels PX. In this case, the backlight BL is set to be turned on during a hold period between the time point of completion of video signal write and the time point of start of black-insertion write.

In the case where the black-insertion driving is executed in the above-described transflective liquid crystal display device, the voltage setting unit may set the pixel voltage for black display, which is applied in the first period, at a black voltage corresponding to the zero gradation level (black display) in the selected mode.

There is a case in which the black voltage corresponding to the zero gradation level differs between when the first mode is selected and when the second mode is selected. In the example shown in FIG. 6, a black voltage in the first mode indicated by the curve A is higher than a black voltage in the second mode. In addition, in the example shown in FIG. 9, a black voltage in the first mode indicated by the curve A is higher than black voltages in the second mode and third mode. In this case, the voltage setting unit should preferably set the pixel voltage for black display, which is applied in the first period, at a highest black voltage in the selectable modes. Thereby, reverse transition of liquid crystal molecules can surely be prevented.

In the above-described embodiments, the pixel voltages are optimized by shifting the power supply voltage, which is the reference voltage, in accordance with the brightness of ambient light. Alternatively, for example, a variable resistor for dividing the power supply voltage may be provided, and the pixel voltages may be optimized by controlling the resistance value of the variable resistor.

In addition, in the above-described embodiments, the pixel voltages are optimized by shifting the power supply voltage, which is the reference voltage, in accordance with the brightness of ambient light. Alternatively, the pixel voltages may be optimized by other methods.

For example, the voltage setting unit may include a plurality of tables in which optimal pixel voltages relative to respective input gradation levels are set in accordance with the brightness of ambient light. These tables correspond to pixel voltages which are to be set in relation to the input gradation levels, and the tables are prepared in advance in association with each of brightness levels to be detected. In this case, the gradation reference voltage generating circuit 7 has a function of selecting one of the tables in accordance with the ambient brightness that is detected by the sensor unit 9, and setting the power supply voltage that is the reference voltage. By making use of this function, the gradation reference voltage generating circuit 7 generates a predetermined number of gradation reference voltages VREF. The source driver XD is configured to refer to the predetermined number of gradation reference voltages VREF which are supplied from the gradation reference voltage generating circuit 7, and to set the pixel voltages Vs relative to the input gradation. The source driver XD converts the pixel data DO, which are supplied from the image data conversion circuit 13, to pixel voltages Vs, and outputs the pixel voltages Vs to the source lines X1 to Xn in a parallel fashion.

With this structure, like the preceding embodiments, a display screen with a predetermined image quality can be displayed on the liquid crystal display panel DP regardless of the ambient brightness.

The mode switching, for example, the shift of the power supply voltage, should preferably be executed, for example, in a vertical blanking period between frames, in order to prevent disturbance of a display image. In a case where color display is realized by successively illuminating red, blue and green backlights, without using a color filter, it is preferable to shift the power supply voltage between frames, and not between color fields.

The present invention is not limited directly to the above-described embodiments. In practice, the structural elements can be modified without departing from the spirit of the invention. Various inventions can be made by properly combining the structural elements disclosed in the embodiments. For example, some structural elements may be omitted from all the structural elements disclosed in the embodiments. Furthermore, structural elements in different embodiments may properly be combined.

What is claimed is:

1. A liquid crystal display device including a reflective display part having predetermined reflectance characteristics relative to input gradation levels and a transmissive display part having predetermined transmittance characteristics relative to the input gradation levels in each of a plurality of matrix-arrayed pixels, comprising:

a liquid crystal display panel which is configured such that a liquid crystal layer is held between a pair of substrates and gradation display is performed in accordance with a pixel voltage which is applied to the liquid crystal layer of each pixel;

a backlight which illuminates the liquid crystal display panel;

a sensor unit which detects brightness of ambient light; and a voltage setting unit which sets the pixel voltage of the reflective display part and the pixel voltage of the transmissive display part in each of the pixels, relative to each of the input gradation levels, wherein the voltage setting unit is configured to set the pixel voltage based on the brightness of the ambient light that is detected by the sensor unit, and in the case where the detected brightness is a threshold value or less, the voltage setting unit selects a first mode to set the pixel voltage relative to each of the input gradation levels within a first voltage range based on the transmittance characteristics in the transmissive display part, and in the case where the detected brightness is higher than the threshold value, the voltage setting unit selects a second mode to set the pixel voltage relative to each of the input gradation levels within a second voltage range lower than the first voltage range based on the reflectance characteristics in the reflective display part.

2. The liquid crystal display device according to claim 1, wherein the voltage setting unit sets the pixel voltage in such a manner that the reflectance characteristics relative to the input gradation levels at a time when a reflectance at a maximum gradation level at the reflective display part, in the case where the detected brightness is higher than a threshold value, is 1, substantially agree with the transmittance characteristics relative to the input gradation levels at a time when a transmittance at a maximum gradation level at the transmissive display part, in the case where the detected brightness is the threshold value or less, is 1.

3. The liquid crystal display device according to claim 1, wherein the voltage setting unit shifts a power supply voltage in accordance with the brightness of the ambient light, and sets the pixel voltage relative to each of the input gradation levels.

4. The liquid crystal display device according to claim 1, wherein the voltage setting unit includes a plurality of tables of pixel voltages that are to be set relative to the respective input gradation levels, selects one of the tables in accordance with the brightness of the ambient light, and sets the pixel voltage relative to each of the input gradation levels.

5. The liquid crystal display device according to claim 1, wherein liquid crystal molecules which are included in the liquid crystal layer are bend-aligned between the pair of substrates in a predetermined display state.

6. The liquid crystal display device according to claim 1, wherein the voltage setting unit selects, in a predetermined time period, a third mode, in which pixel voltages in a range between the pixel voltages in the first mode and the pixel voltages in the second mode are set relative to the input gradation levels, when the brightness that is detected by the sensor unit is higher than a threshold or when the brightness that is detected by the sensor unit is lower than the threshold.

7. The liquid crystal display device according to claim 1, wherein the voltage setting unit sets, in a predetermined time period within one frame period, a pixel voltage for black display, which is applied to the liquid crystal layer, at a higher one of a black voltage in the first mode and a black voltage in the second mode.

* * * * *